US012636586B2

(12) United States Patent
Morrison et al.

(10) Patent No.: US 12,636,586 B2
(45) Date of Patent: May 26, 2026

(54) SWING APPARATUS

(71) Applicant: FFS-IP LLC, Springville, UT (US)

(72) Inventors: Jimmy Morrison, Springville, UT (US); Nathan Thompson, Twin Falls, ID (US)

( * ) Notice: Subject to any disclaimer, the term of this patent is extended or adjusted under 35 U.S.C. 154(b) by 503 days.

(21) Appl. No.: 18/356,210

(22) Filed: Jul. 20, 2023

(65) Prior Publication Data

US 2024/0024789 A1 Jan. 25, 2024

Related U.S. Application Data

(60) Provisional application No. 63/390,745, filed on Jul. 20, 2022.

(51) Int. Cl.
*A63G 9/00* (2006.01)

(52) U.S. Cl.
CPC ..... *A63G 9/00* (2013.01)

(58) Field of Classification Search
CPC . A63G 21/18; A63G 3/00; A63G 3/02; A63G 31/007; A63G 3/06; A63G 31/00; A63G 29/00; A63G 21/00; A63G 9/00; A63G 21/02; A63G 33/00; A63G 31/16; A63G 5/00; A63G 31/02; A63G 7/00; A63G 1/28; A63G 27/00; A63G 31/12; A63G 1/10; A63G 1/30; A63G 2200/00; A63G 25/00; A63G 9/02; A63G 9/12
See application file for complete search history.

(56) References Cited

U.S. PATENT DOCUMENTS 2,720,664 A * 10/1955 Gray ..... B63C 9/00 114/43
2,724,843 A * 11/1955 Kimball ..... A47C 15/006 441/131
3,748,672 A * 7/1973 Patrick ..... B63B 34/52 441/131
5,295,885 A * 3/1994 Karl ..... B63B 34/565 441/131
9,854,898 B2 * 1/2018 Whitley ..... A45F 3/26
D943,044 S * 2/2022 Wang ..... B63B 34/52 D21/823

(Continued)

FOREIGN PATENT DOCUMENTS

DE 202022106727 U1 * 1/2023 ..... A63G 9/00

OTHER PUBLICATIONS

DE202022106727 Machine translation (Year: 2020).*

*Primary Examiner* — Brian O Peters
(74) *Attorney, Agent, or Firm* — Crandall IP

(57) ABSTRACT

A swing apparatus includes an inner compartment comprising an inner tube, a covering that is configured to cover the inner compartment, and at least two straps including a first strap and a second strap that are each secured to a bottom of the covering and which are configured to extend above the covering and inner compartment with at least two attachment couplings. A first end of the first strap is coupled to a first end of the second strap to form the first attachment coupling. A second end of the first strap is coupled to a second end of the second strap to form a second attachment coupling, wherein the first end of the first strap and the second end of the first strap extend from the covering on opposite sides of the covering.

19 Claims, 8 Drawing Sheets

(56) References Cited

U.S. PATENT DOCUMENTS

| | | | | |
|---|---|---|---|---|
| 2012/0058696 | A1* | 3/2012 | Whitman | B63B 34/52<br>441/66 |
| 2015/0157888 | A1* | 6/2015 | Gordon | A63G 29/00<br>482/27 |

* cited by examiner

SWING APPARATUS

BACKGROUND

This disclosure relates generally to a swing apparatus. More specifically, this disclosure relates generally to a swing apparatus including an inflatable inner tube covered by a permeable nylon covering. In addition, this disclosure relates generally to a swing apparatus with strap attachment.

SUMMARY

The subject matter of the present application has been developed in response to the present state of the art, and in particular, in response to the problems and disadvantages associated with conventional swings that have not yet been fully solved by currently available techniques. Accordingly, the subject matter of the present application has been developed to provide embodiments of a system, apparatus, and method that overcome at least some of the shortcomings of prior art techniques.

Disclosed herein is a swing apparatus. The swing apparatus includes an inner compartment comprising an inner tube, a covering that is configured to cover the inner compartment, and at least two straps including a first strap and a second strap that are each secured to a bottom of the covering and which are configured to extend above the covering and inner compartment with at least two attachment couplings. A first end of the first strap is coupled to a first end of the second strap to form the first attachment coupling. A second end of the first strap is coupled to a second end of the second strap to form a second attachment coupling, wherein the first end of the first strap and the second end of the first strap extend from the covering on opposite sides of the covering, and wherein the first end of the second strap and the second end of the second strap extend from the covering on opposite sides of the covering. The preceding subject matter of this paragraph characterizes example 1 of the present disclosure.

The inner tube is inflatable through an inflation valve. The preceding subject matter of this paragraph characterizes example 2 of the present disclosure, wherein example 2 also includes the subject matter according to example 1, above.

The inner compartment further comprises a support piece coupled to the inner tube, wherein the support piece comprises a plurality of apertures configured to allow the egress of a liquid. The preceding subject matter of this paragraph characterizes example 3 of the present disclosure, wherein example 3 also includes the subject matter according to any one of examples 1-2, above.

The covering comprises a peripherally enclosing fabric that is configured to cover the periphery of the inner compartment and bottom of the inner compartment. The preceding subject matter of this paragraph characterizes example 4 of the present disclosure, wherein example 4 also includes the subject matter according to any one of examples 1-3, above.

The covering further comprises a bottom mesh component that is coupled to the peripherally enclosing fabric and is centered on a bottom of the swing apparatus below the support piece of the inner compartment. The preceding subject matter of this paragraph characterizes example 5 of the present disclosure, wherein example 5 also includes the subject matter according to any one of examples 1-4, above.

The covering further comprises a top seating fabric that is coupled to the peripherally enclosing fabric and be centered on a top of the covering above the support piece of the inner compartment. The preceding subject matter of this paragraph characterizes example 6 of the present disclosure, wherein example 6 also includes the subject matter according to any one of examples 1-5, above.

The top seating fabric is stretchable. The preceding subject matter of this paragraph characterizes example 7 of the present disclosure, wherein example 7 also includes the subject matter according to any one of examples 1-6, above.

The first strap and the second strap cross each other orthogonally at a bottom of the covering such that the first strap overlaps the second strap. The preceding subject matter of this paragraph characterizes example 8 of the present disclosure, wherein example 8 also includes the subject matter according to any one of examples 1-7, above.

The first strap and the second strap cross each other obliquely at a bottom of the covering such that the first strap overlaps the second strap. The preceding subject matter of this paragraph characterizes example 9 of the present disclosure, wherein example 9 also includes the subject matter according to any one of examples 1-8, above.

The first attachment coupling comprises an end attachment handle loop and at least one intermediary attachment loop. The preceding subject matter of this paragraph characterizes example 10 of the present disclosure, wherein example 10 also includes the subject matter according to any one of examples 1-9, above.

The first attachment coupling comprises an end attachment handle loop and a plurality of intermediary attachment loops configured to allow the swing height to be adjusted. The preceding subject matter of this paragraph characterizes example 11 of the present disclosure, wherein example 11 also includes the subject matter according to any one of examples 1-10, above.

The intermediary attachment loops are formed with an opening between the first strap and the second strap which are sewn together at a first point and a second point. The preceding subject matter of this paragraph characterizes example 12 of the present disclosure, wherein example 12 also includes the subject matter according to any one of examples 1-11, above.

Disclosed herein is a swing apparatus. The swing apparatus includes an inner compartment comprising an inner tube, a covering that is configured to cover the inner compartment, and at least two straps including a first strap and a second strap that are each secured to a bottom of the covering and which are configured to extend above the covering and inner compartment with at least two attachment couplings. A first end of the first strap is coupled to a first end of the second strap to form the first attachment coupling. A second end of the first strap is coupled to a second end of the second strap to form a second attachment coupling, wherein the first end of the first strap and the second end of the first strap extend from the covering on opposite sides of the covering, and wherein the first end of the second strap and the second end of the second strap extend from the covering on opposite sides of the covering. The inner tube is inflatable through an inflation valve. The inner compartment further comprises a support piece coupled to the inner tube, wherein the support piece comprises a plurality of apertures configured to allow the egress of a liquid. The covering comprises a peripherally enclosing fabric that is configured to cover the periphery of the inner compartment and bottom of the inner compartment. The covering further comprises a bottom mesh component that is coupled to the peripherally enclosing fabric and is centered on a bottom of the swing apparatus below the support piece of the inner compartment. The covering further comprises a top seating fabric that is coupled to the peripherally enclosing fabric and be centered on a top of the covering above the support piece of the inner compartment. The preceding subject matter of this paragraph characterizes example 13 of the present disclosure.

The top seating fabric is stretchable. The preceding subject matter of this paragraph characterizes example 14 of the present disclosure, wherein example 14 also includes the subject matter according to example 13, above.

The first strap and the second strap cross each other orthogonally at a bottom of the covering such that the first strap overlaps the second strap. The preceding subject matter of this paragraph characterizes example 15 of the present disclosure, wherein example 15 also includes the subject matter according to any one of examples 13-14, above.

The first strap and the second strap cross each other obliquely at a bottom of the covering such that the first strap overlaps the second strap. The preceding subject matter of this paragraph characterizes example 16 of the present disclosure, wherein example 16 also includes the subject matter according to any one of examples 13-15, above.

The first attachment coupling comprises an end attachment handle loop and at least one intermediary attachment loop. The preceding subject matter of this paragraph characterizes example 17 of the present disclosure, wherein example 17 also includes the subject matter according to any one of examples 13-16, above.

The first attachment coupling comprises an end attachment handle loop and a plurality of intermediary attachment loops configured to allow the swing height to be adjusted. The preceding subject matter of this paragraph characterizes example 18 of the present disclosure, wherein example 18 also includes the subject matter according to any one of examples 13-17, above.

The intermediary attachment loops are formed with an opening between the first strap and the second strap which are sewn together at a first point and a second point. The preceding subject matter of this paragraph characterizes example 19 of the present disclosure, wherein example 19 also includes the subject matter according to any one of examples 13-18, above.

BRIEF DESCRIPTION OF DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered limiting of its scope, the subject matter will be described and explained with additional specificity and detail through the use of the drawings.

Figure 1:
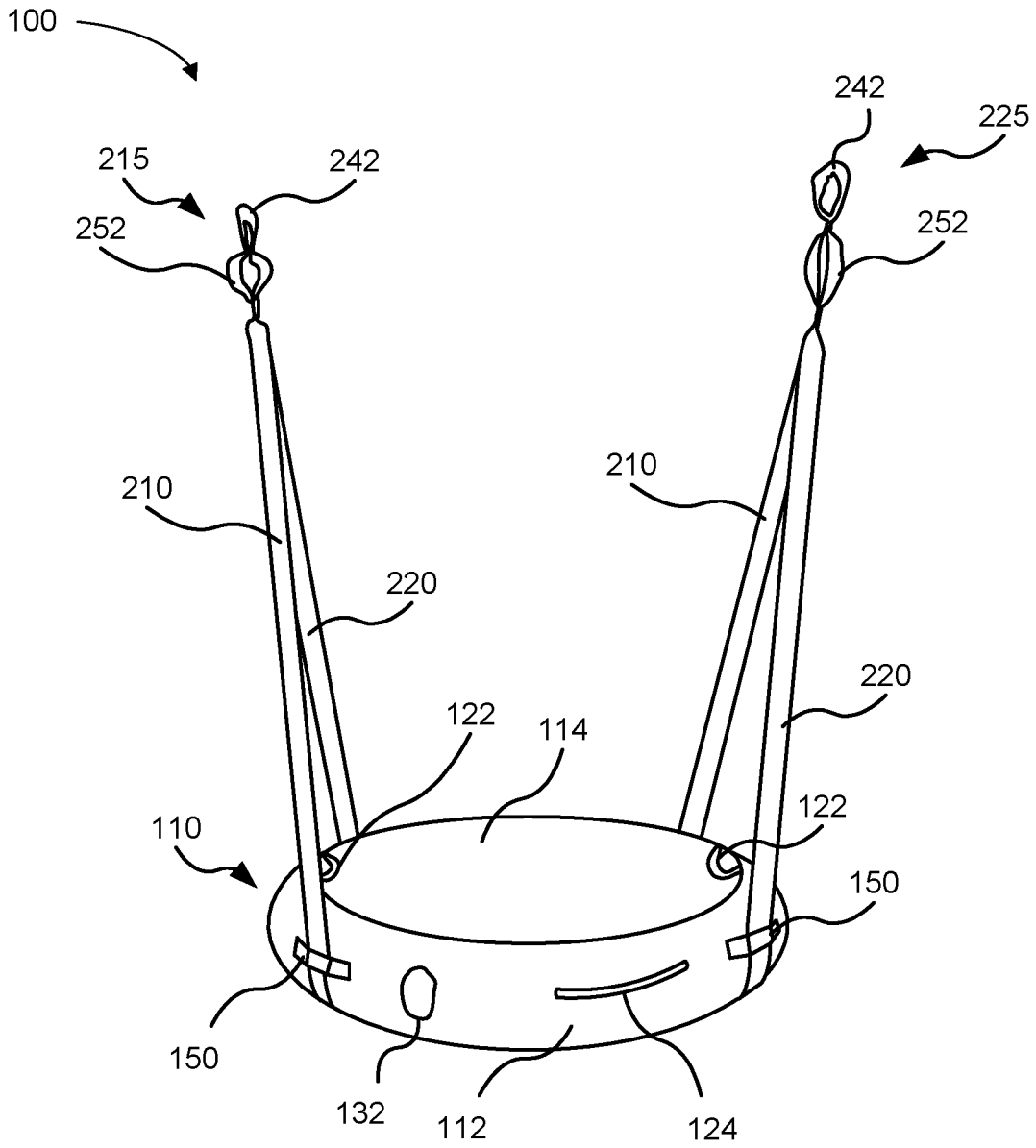
FIG. 1 depicts a front perspective view of a swing apparatus, according to one or more embodiments of the invention.

Throughout this application, similar designations or vocabulary may be used to identify similar elements, although the breadth of this disclosure should be understood to incorporate any alternatives and variations referenced within the specification (including the claims) and the accompanying drawings.

DETAILED DESCRIPTION

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment," "an embodiment," or similar language means that a particular feature, structure, or characteristic described in connection with the indicated embodiment is included in at least one embodiment of the present invention. Thus, the phrases "in one embodiment," "in an embodiment," and similar language throughout this specification may, but do not necessarily, all refer to the same embodiment.

While many embodiments are described herein, at least some of the described embodiments describe a swing apparatus. In an illustrative embodiment, the swing apparatus includes an inner compartment, a covering over the inner compartment, and at least two straps. In some embodiments, the inner compartment is inflatable. In the illustrative embodiment, the inner compartment is a tube in the general shape of a torus. In some embodiments, the inner compartment is a donut shaped inner tube. In some embodiments, instead of having a space in the central area of the inner tube, the inner compartment includes a generally flat support piece. The support piece connects to or forms from the inner radius of the inner tube covering the space. The support piece is seated low on the inner tube to allow a user to sit in the inner tube as they normally would. The support piece provides structural support for the inner compartment to keep the inner tube from being deformed to a great extent during use of the swing apparatus. The support piece includes apertures or perforations that allow for the egress of water or other liquid substances to the ground. This allows the swing apparatus to be drained or excess water that might otherwise accumulate above the support piece. The number, location, size, and pattern of the apertures or perforations may vary but function to allow for the egress of water without limiting the structural integrity of the inner compartment and especially the inner tube. Some embodiments may not include the support piece.

In some embodiments, the swing apparatus includes a covering that is configured to cover the inner compartment. The covering may function to protect the inner compartment (especially when the inner compartment is inflatable). The covering may protect the inner compartment from tears or punctures that would deflate the inner compartment. In some embodiments, the covering is permeable to water and other liquids. The permeability allows the covering to also drain any water buildup on the top of the swing sitting surface.

In some embodiments, the covering is one unitary piece and material but in other embodiments the covering includes various features and sub-components. In an illustrative embodiment, the covering includes: a peripherally enclosing fabric that is configured to cover the periphery of the inner compartment and bottom of the inner tube; a bottom mesh component that is configured to sit just below the support piece; a top seating fabric that is configured to be above the support piece as a seating area of the swing apparatus.

The peripherally enclosing fabric is configured to support and enclose the majority of the inner compartment (or inner tube). The peripherally enclosing fabric is a sturdy fabric with less stretchability than the top seating fabric. The peripherally enclosing fabric supports and strengthens the inner compartment and may be configured to withstand wear and tear during use of the swing apparatus. In some embodiments, the peripherally enclosing fabric is a durable nylon material. In the illustrative embodiment, the peripherally enclosing fabric covers the outer diameter of the inner tube and further covers the bottom of the inner tube.

In the illustrative embodiment, the bottom mesh component is found centered on the bottom of the covering. The bottom mesh component is a meshed fabric that allows for the drainage of water from the swing apparatus. In the illustrative embodiment, the bottom mesh component is circular and sized to match the support piece or be smaller than the support piece. The primary function of the bottom mesh component is to allow for egress of liquids and does not provide as much structural support as the peripherally enclosing fabric. In the illustrative embodiment, the peripherally enclosing fabric and the bottom mesh component are joined by sewing the pieces together. Other common methods of coupling are envisioned. In addition, in the illustrative embodiment, the peripherally enclosing fabric and the bottom mesh component are further secured together by the straps (described in more detail below).

In addition, the covering includes a top seating fabric that is coupled to the peripherally enclosing fabric and is centered above the support piece. The top seating fabric is generally circular and covers the top of the inner tube and is generally larger than the support piece. In the illustrative embodiment, the top seating fabric is flexible and stretchable. The top seating fabric is much more stretchable than the peripherally enclosing fabric. This is for comfort of the seating area of the swing apparatus. The stretchable top seating fabric allows a user to sink into the inner tube and sit comfortably on the swing apparatus. In some embodiments, the top seating fabric, while permeable, may have less permeability than the bottom mesh component. As such, in some embodiments, the top seating fabric has two openings at the periphery of the top seating fabric. These openings are between the top seating fabric and the peripherally enclosing fabric. In some embodiments, the openings may be further covered by a mesh similar to the bottom mesh component and they will allow for more egress of liquids.

Although the covering is described with certain components and functionality, other embodiments of the covering may include fewer or more components to implement less or more functionality.

In an illustrative embodiment, the swing apparatus includes two handles that are secured at the seam between the top seating fabric and the peripherally enclosing fabric. These handles may be sewn at the joint between the top seating fabric and the peripherally enclosing fabric. In the illustrative embodiment, the top seating fabric and the peripherally enclosing fabric are coupled together by sewing them together and may further have a joining strip that is sewn to each of the top seating fabric and the peripherally enclosing fabric. The handles would also be sewn to this joining strip.

In an illustrative embodiment, the covering includes a flap. The flap can be opened to expose an inflation valve on the inner compartment. This allows a user to easily inflate and deflate the inner compartment through an access opening on the covering without removing the inner compartment from the covering. The inflation valve will be aligned with the access opening. In the illustrative embodiment, flap and access opening are located on the peripherally enclosing fabric.

In the illustrative embodiment, the covering further includes an insertion slit on the side of the peripherally enclosing fabric. The insertion slit allows the user to easily insert and remove the inner compartment from the covering. The insertion slit can be closeable by Velcro or a zipper or other similar mechanism.

The swing apparatus includes at least two straps. The straps are secured to the covering and extend all the way across the bottom of the covering. In the illustrative embodiment, the swing apparatus includes two straps. The straps are secured directly to the covering in a criss-cross pattern. In the illustrative embodiment, the straps are secured orthogonally to each other. In other embodiments, the straps may cross in a more oblique intersection. The straps are secured all along the bottom and sides of the covering. The straps are not secured on the top of the covering but extend away from the covering and are coupled together at each of their ends to form one coupling (two in total) that can be attached to a tree or swing set or to whatever the swing apparatus is being attached.

In the illustrative embodiment, where the straps finish their securing to the covering, there is a three-box reinforcement support to make sure that the straps don't become detached from the covering over time.

The straps are secured to the covering by sewing each lengthwise side of the strap the full length of the strap until the three-box reinforcement support. This provides further stability and strength to the covering and thus to the overall swing apparatus. In the illustrative embodiment, the straps are sewn to the peripherally enclosing fabric and to the bottom mesh component. This further secures the peripherally enclosing fabric and to the bottom mesh component together and provides more support to the swing apparatus.

The two straps are secured together at their ends to create an attachment coupling. In the illustrative embodiment, the swing apparatus has two larger attachment couplings on each side of the swing apparatus. The attachment coupling includes a series of circular attachment loops. In the illustrative embodiment, a carabiner is attached to the end attachment handle loop, but the carabiner (or other hardware) can be attached to any of the attachment handles. This allows for the height of the swing apparatus to be easily adjusted to conform to user desire. In the illustrative embodiment, each attachment coupling includes four intermediary attachment loops and an end attachment handle loop.

The attachment loops are formed by securing the two straps together at a first point and a second point spaced along the length of the straps. Each strap is then pinched or folded in the space between the first point and the second point and the two pinched ends are sewn together. This forms a bulge that naturally separates to the two straps between the first point and the second point and allows for the carabiner (or other hardware) to easily be changed from the end attachment handle loop to the intermediary attachment loop.

The various components described herein can be grouped together to form systems that improve upon conventional swings. These various components from generally a drainage system and a suspension system. As an example, the drainage system may be formed of various components described herein. For example, the inner inflatable tube is a solid structure that has the support piece in the middle of the traditional tube "donut" shape. This is for the comfort of the riders. However, this support piece also has a varying number of drainage holes (depending on the size of the swing) that prevent the tube from filling up with water whenever it rains/snows/etc. These holes are reinforced in a unique way, and the inner supportive plastic is joined to the tube. This support piece and the apertures or holes form part of the drainage system. The drainage system may also include the top seating fabric (which is permeable) covering most of the top of the swing apparatus, and the bottom mesh component on the bottom of the swing apparatus. The permeable fabric is stretchy and taken together with bottom mesh component and the apertures of the support piece may form the drainage system.

The suspension system may also be formed of multiple parts or components, but, in an illustrative embodiment, is essentially comprised of the straps criss-crossing under the bottom of the swing apparatus (giving the appearance of four straps when viewed from above the swing apparatus), then joining in a triangle above the swing apparatus. In the illustrative embodiment, the straps go underneath the swing apparatus. These straps are sewn into the swing along every point, including the bottom mesh component underneath the swing where water drains. The straps are also reinforced on the sides of the swing with a 3-box reinforcement. From this reinforcement upwards, the straps are loose. The straps are joined on each side in a triangle formation. Where the straps are joined, they are reinforced with heavy-duty thread. At the top of the suspension system, the straps are sewn into loops as described earlier and shown in the figures. The carabiner (or other hardware) attaching the swing apparatus to the consumer's swing hanger can be attached to any of these loops in order to adjust the height of the swing apparatus. The stability and flexibility of the suspension allow for different configurations without losing reliability and safety.

In some embodiments, all seams between the various components of the swing apparatus are overlapping and sewn twice. This may provide for stability and durability. These embodiments are merely illustrative.

Referring now to FIG. 1, a front perspective view of a swing apparatus 100 is depicted, according to one or more embodiments of the invention. Although the swing apparatus 100 is shown and described with certain components and functionality, other embodiments of the swing apparatus 100 may include fewer or more components to implement less or more functionality.

The illustrated swing apparatus 100 includes an inner compartment (not visible in FIG. 1, see FIGS. 3 and 4), a covering 110 over the inner compartment, and at least two straps 210, 220. In some embodiments, the inner compartment is inflatable. In the illustrated embodiment, the inner compartment is an inner tube with a support piece in the space in the central area of the inner tube (not visible). The support piece connects to or forms from the inner radius of the inner tube and thus covers the space.

In some embodiments, the swing apparatus includes a covering 110 that is configured to cover the inner compartment. The covering 110 may function to protect the inner compartment (especially when the inner compartment is inflatable). The covering 110 may protect the inner compartment from tears or punctures that would deflate the inner compartment. In some embodiments, the covering 110 is permeable to water and other liquids. The permeability allows the covering 110 to also drain any water buildup on the top of the swing apparatus 100 sitting surface.

In some embodiments, the covering 110 is one unitary piece and material but in the illustrated embodiment, the covering 110 includes various features and sub-components. In the illustrated embodiment, the covering includes: a peripherally enclosing fabric 112 that is configured to cover the periphery of the inner compartment and bottom of the inner tube; a bottom mesh component 116 (not visible, see FIG. 6) that is configured to sit just below the support piece; a top seating fabric 114 that is configured to be above the support piece as a seating area of the swing apparatus.

The peripherally enclosing fabric 112 is configured to support and enclose the majority of the inner compartment or inner tube. The peripherally enclosing fabric 112 is a sturdy fabric with less stretchability than the top seating fabric 114. The peripherally enclosing fabric 112 supports and strengthens the inner compartment and may be configured to withstand wear and tear during use of the swing apparatus. In some embodiments, the peripherally enclosing fabric 112 is a durable nylon material. In the illustrated embodiment, the peripherally enclosing fabric 112 covers the outer diameter of the inner tube and further covers a majority of the bottom of the inner tube.

Figure 6:
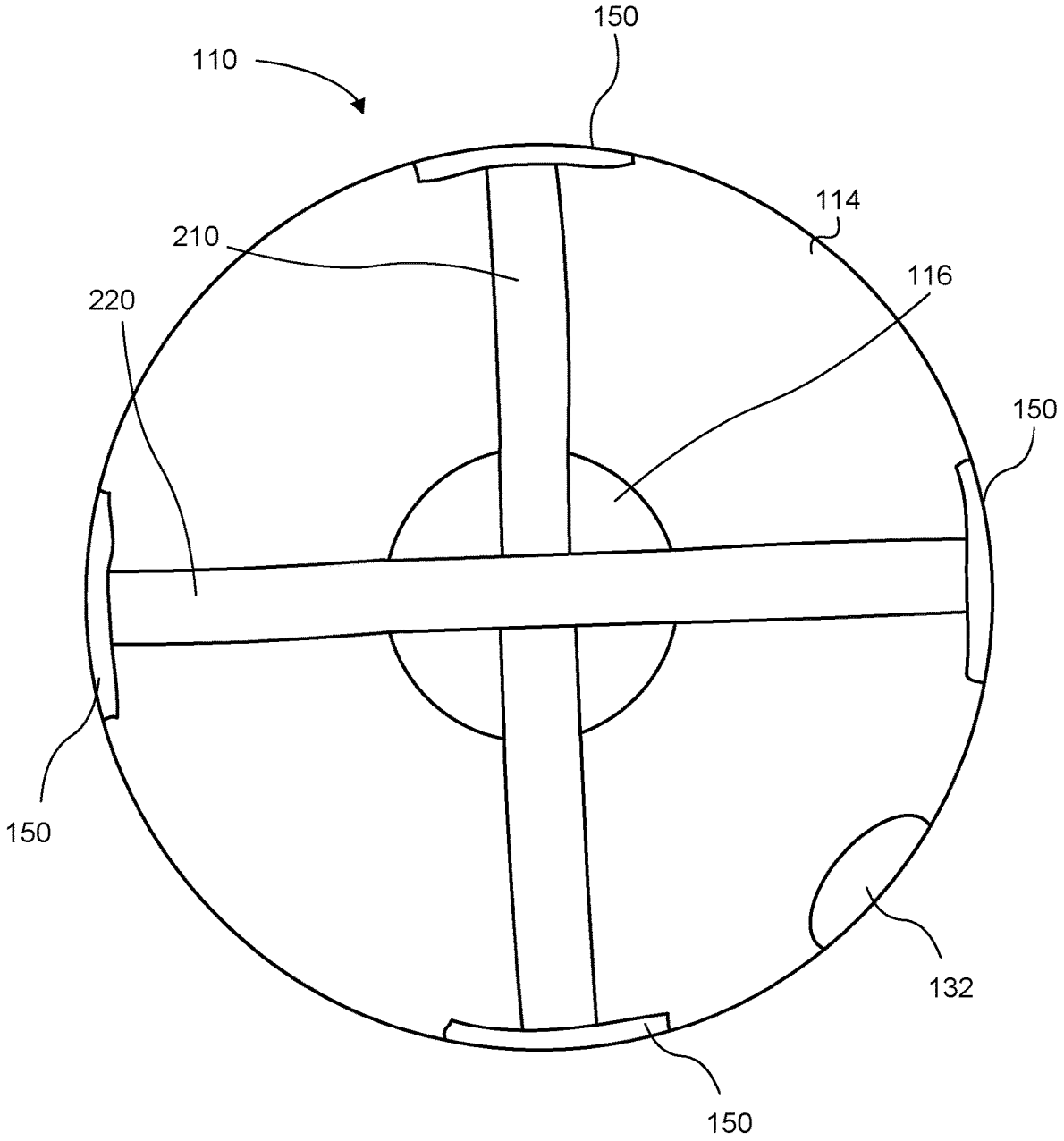
FIG. 6 depicts a bottom view of the covering of a swing apparatus, according to one or more embodiments of the invention.

In the illustrated embodiment, the bottom mesh component 116 (not visible) is found centered on the bottom of the covering (See FIG. 6). The bottom mesh component 116 is a meshed fabric that allows for the drainage of water from the swing apparatus. In the illustrated embodiment, the bottom mesh component 116 is circular and sized to match the support piece or be smaller than the support piece. The primary function of the bottom mesh component 116 is to allow for egress of liquids and does not provide as much structural support as the peripherally enclosing fabric 112. In the illustrated embodiment, the peripherally enclosing fabric 112 and the bottom mesh component 116 are joined by sewing the pieces together. Other common methods of coupling are envisioned and embodiments herein are not restricted to being coupled through sewing. In addition, in the illustrated embodiment, the peripherally enclosing fabric 112 and the bottom mesh component 116 are further secured together by the straps (not visible but described in more detail below).

In addition, the covering includes a top seating fabric 114 that is coupled to the peripherally enclosing fabric 112 and is centered above the support piece of the inner tube. The top seating fabric 114 is generally circular (but could be other shapes) and covers the top of the inner tube and is generally larger in size or diameter than the support piece. In the illustrated embodiment, the top seating fabric 114 is flexible and stretchable. The top seating fabric 114 is much more stretchable than the peripherally enclosing fabric 112. This is for comfort of the seating area of the swing apparatus 100. The stretchable top seating fabric 114 allows a user to sink into the space created by the inner tube and sit comfortably on the swing apparatus 100. In some embodiments, the top seating fabric 114, while permeable, may have less permeability than the bottom mesh component 116. As such, in some embodiments, the top seating fabric 114 has two openings (see FIG. 5) at the periphery of the top seating fabric 114. These openings are between the top seating fabric 114 and the peripherally enclosing fabric 112. In some embodiments, the openings may be further covered by a mesh similar to the bottom mesh component 116 and they will allow for more egress of liquids. Although the covering 110 is described with certain components and functionality, other embodiments of the covering may include fewer or more components to implement less or more functionality.

In the illustrated embodiment, the swing apparatus includes two handles 122 that are secured at the seam between the top seating fabric 114 and the peripherally enclosing fabric 112. These handles may be sewn at the joint between the top seating fabric 114 and the peripherally enclosing fabric 112. In the illustrated embodiment, the top seating fabric 114 and the peripherally enclosing fabric 112 are coupled together by sewing them together and may further have a joining strip that is sewn to each of the top seating fabric 114 and the peripherally enclosing fabric 112. The handles 122 would also be sewn to this joining strip which is configured to overlap both the top seating fabric 114 and the peripherally enclosing fabric 112.

In the illustrated embodiment, the covering includes a flap 132. The flap 132 can be opened to expose an inflation valve (not visible) on the inner compartment. This allows a user to easily inflate and deflate the inner compartment through an access opening (covered by the flap 132) on the covering 110 without removing the inner compartment from the covering 110. The inflation valve will be aligned with the access opening. In the illustrated embodiment, flap 132 and access opening are located on the peripherally enclosing fabric 112 but may be located elsewhere in other embodiments.

In the illustrated embodiment, the covering 110 further includes an insertion slit 124 on the side of the peripherally enclosing fabric 112. The insertion slit 124 allows the user to easily insert and remove the inner compartment from the covering 110 if needed. The insertion slit 124 as well as the flap can be closeable by Velcro or a zipper or other similarly functioning mechanism.

The swing apparatus 100 includes at least two straps 210, 220. The straps 210, 220 are secured to the covering 110 and extend all the way across the bottom of the covering 110 (shown in FIG. 6). In the illustrated embodiment, the swing apparatus 100 includes two straps, a first strap 210 and a second strap 220. The straps 210, 220 are secured directly to the covering 110 and form a criss-cross pattern on the bottom of the swing apparatus 100 (this is visible in FIG. 6). In the illustrated embodiment, the straps 210, 220 are secured orthogonally to each other on the bottom. As such, it can be seen that the first strap 210 extends above the covering 110 on opposite sides. This is also true for the second strap 220. A first end of the first strap 210 is secured or sewn together with a first end of the second strap 220 from a first attachment coupling 215. A second end of the first strap 210 is secured or sewn together with a second end of the second strap 220 to form a second attachment coupling 225.

The straps 210, 220 are secured all along the bottom and sides of the covering 110. The straps 210, 220 are not secured on the top of the covering but extend away from the covering 110 as shown and are coupled together at each of their ends (as described above) to form the attachment couplings 215, 225 (two in total) that can be attached to a tree, rope, or swing set or to whatever the swing apparatus 100 is being attached.

In the illustrated embodiment, where the straps finish their securing to the covering, there is a three-box reinforcement support 150 to make sure that the straps don't become detached from the covering 110 over time.

The straps 210, 220 are secured to the covering 110 by sewing each lengthwise side of the strap the full length of the strap until the three-box reinforcement support 150. This provides further stability and strength to the covering 110 and thus to the overall swing apparatus 100. In the illustrated embodiment, the straps 210, 220 are sewn to the peripherally enclosing fabric 112 and to the bottom mesh component 116. This further secures the peripherally enclosing fabric 112 and to the bottom mesh component 116 together and provides more support to the swing apparatus (see FIG. 6 for this depiction).

The two straps 210, 220 are secured together at their ends to create attachment couplings 215, 225 which includes an end attachment handle loop 242 and an intermediary attachment handle loop 252. In the illustrated embodiment, the swing apparatus 100 has two larger attachment couplings 215, 225 on each side of the swing apparatus. The attachment coupling 215, 225 may include a series of circular intermediary attachment handle loops 252. In the illustrated embodiment, a single intermediary attachment handle loop 252 is shown on each attachment coupling. This allows for the height of the swing apparatus to be easily adjusted to conform to user desire as the swing apparatus 100 can be secured any loop. In the illustrated embodiments of FIGS. 9 and 10, each attachment coupling 215 includes four intermediary attachment loops 252 and an end attachment handle loop 242.

The attachment loops are formed by securing the two straps together at a first point and a second point spaced along the length of the straps. Each strap is then pinched or folded in the space between the first point and the second point and the two pinched ends are sewn together. This forms a bulge that naturally separates to the two straps between the first point and the second point and allows for the carabiner (or other hardware) to easily be changed from the end attachment handle loop to the intermediary attachment loop.

The various components described herein can be grouped together to form systems that improve upon conventional swings. These various components from generally a drainage system and a suspension system. As an example, the drainage system may be formed of various components described herein. For example, the inner inflatable tube is a solid structure that has the support piece in the middle of the traditional tube "donut" shape. This is for the comfort of the riders. However, this support piece also has a varying number of drainage holes (depending on the size of the swing) that prevent the tube from filling up with water whenever it rains/snows/etc. These holes are reinforced in a unique way, and the inner supportive plastic is joined to the tube. This support piece and the apertures or holes form part of the drainage system. The drainage system may also include the top seating fabric 114 (which is permeable) covering most of the top of the swing apparatus, and the bottom mesh component 116 on the bottom of the swing apparatus. The permeable fabric is stretchy and taken together with bottom mesh component 116 and the apertures of the support piece may form the drainage system.

The suspension system may also be formed of multiple parts or components, but, in the illustrated embodiment, is essentially comprised of the straps criss-crossing under the bottom of the swing apparatus 100 (giving the appearance of four straps when viewed from above the swing apparatus), then joining in a triangle above the swing apparatus. In the illustrated embodiment, the straps go underneath the swing apparatus. These straps 210, 220 are sewn into the swing along every point, including the bottom mesh component 116 underneath the swing where water drains. The straps are also reinforced on the sides of the swing with a 3-box reinforcement. From this reinforcement upwards, the straps are loose. The straps are joined on each side in a triangle formation. Where the straps are joined, they are reinforced with heavy-duty thread. At the top of the suspension system, the straps are sewn into loops as described earlier and shown in the figures. The carabiner (or other hardware) attaching the swing apparatus to the consumer's swing hanger can be attached to any of these loops in order to adjust the height of the swing apparatus. The stability and flexibility of the suspension allow for different configurations without losing reliability and safety.

Figure 2:
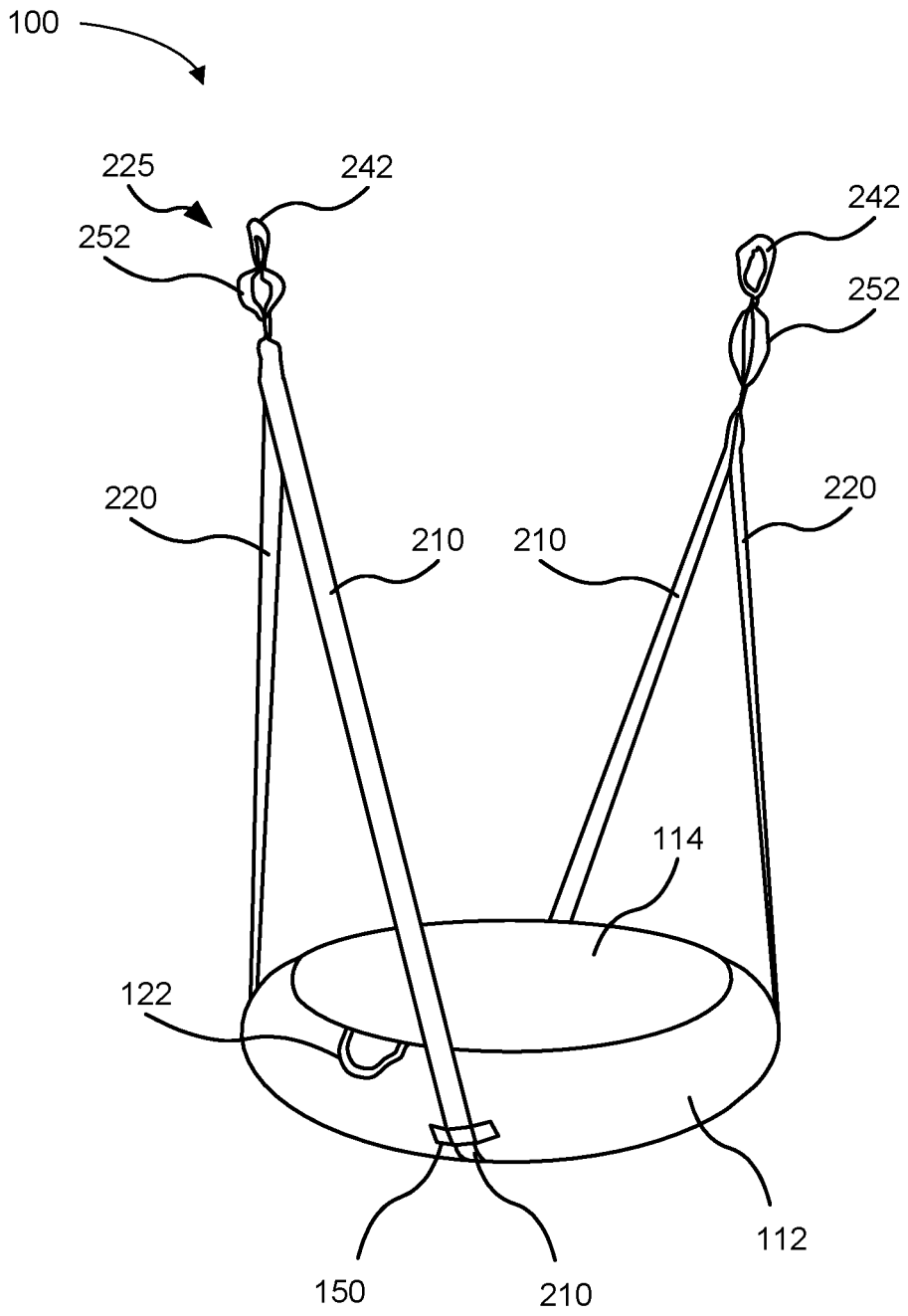
FIG. 2 depicts a perspective view of a swing apparatus from an opposite side as viewed in FIG. 1, according to one or more embodiments of the invention.

FIG. 2 depicts a perspective view of a swing apparatus from an opposite side as viewed in FIG. 1.

Figure 3:
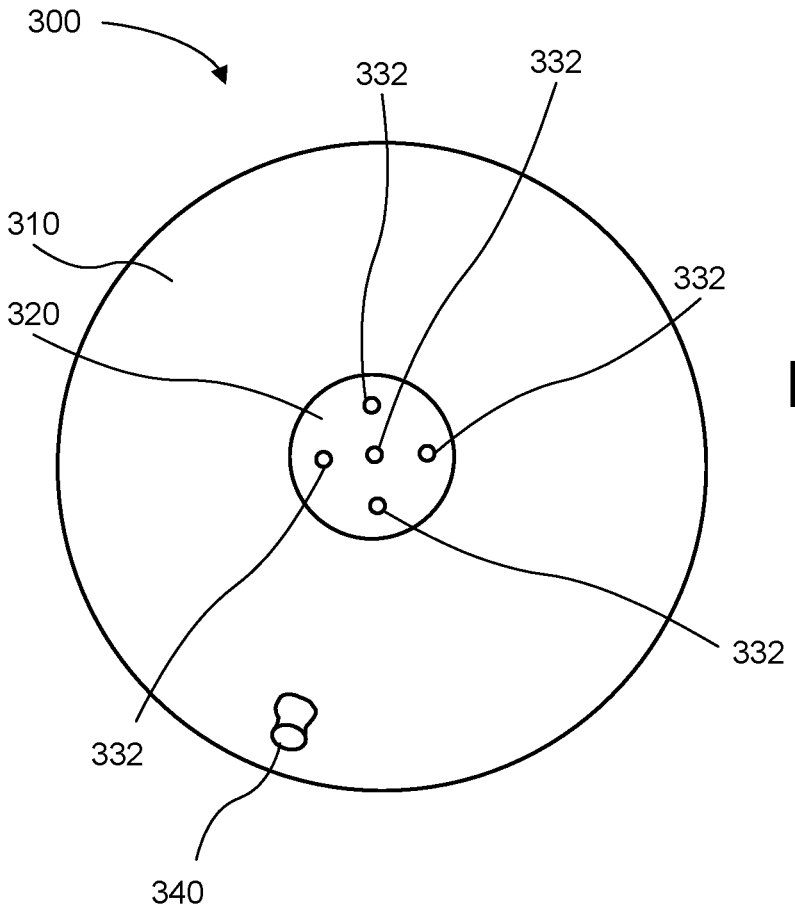
FIG. 3 depicts a bottom view of an inner compartment, according to one or more embodiments of the invention.

FIG. 3 depicts a bottom view of an inner compartment 300, according to one or more embodiments of the invention. In the illustrated embodiment, the inner compartment 300 is an inner tube 310 in the general shape of a torus. In some embodiments, the inner compartment 300 is a donut shaped inner tube. In some embodiments, instead of having a space in the central area of the inner tube 310, the inner compartment includes a generally flat support piece 320. The support piece 320 connects to or forms from the inner radius of the inner tube 310 covering the space. The support piece 320 is a flat plastic piece that is seated low on the inner tube 310 to allow a user to sit in the inner tube as they normally would. The support piece 320 provides structural support for the inner compartment 300 to keep the inner tube 310 from being deformed to a great extent during use of the swing apparatus 100. The support piece 320 includes apertures 332 or perforations that allow for the egress of water or other liquid substances to the ground. This allows the swing apparatus to be drained or excess water that might otherwise accumulate above the support piece. The number, location, size, and pattern of the apertures or perforations may vary but function to allow for the egress of water without limiting the structural integrity of the inner compartment and especially the inner tube. Some embodiments may not include the support piece. Also illustrated is the inflation valve 340.

Figure 4:
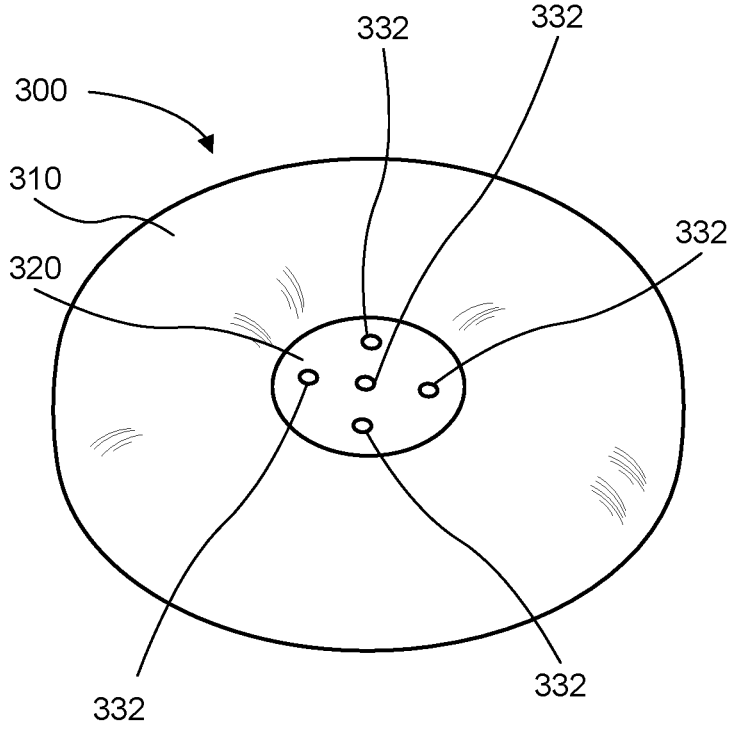
FIG. 4 depicts a top perspective view of the inner compartment of FIG. 3, according to one or more embodiments of the invention.

FIG. 4 depicts a top perspective view of the inner compartment 300 of FIG. 3, according to one or more embodiments of the invention.

Figure 5:
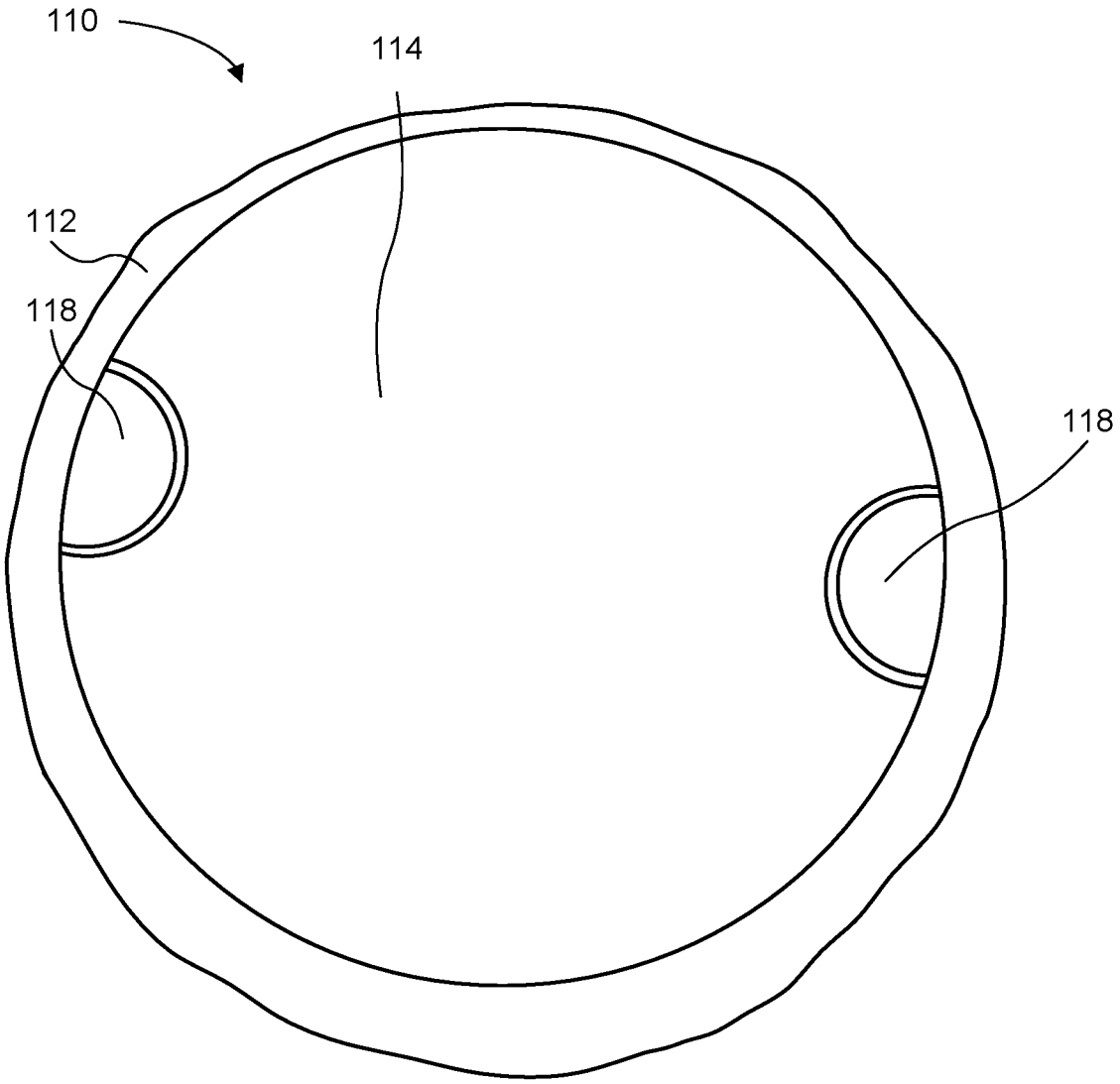
FIG. 5 depicts a top view of the covering of a swing apparatus, according to one or more embodiments of the invention.

FIG. 5 depicts a top view of the covering 110 of a swing apparatus 100, according to one or more embodiments of the invention. FIG. 6 depicts a bottom view of the covering 110 of a swing apparatus 100, according to one or more embodiments of the invention. As illustrated in these figures, the covering 110 includes: a peripherally enclosing fabric 112 that is configured to cover the periphery of the inner compartment and bottom of the inner tube; a bottom mesh component 116 that is configured to sit just below the support piece; a top seating fabric 114 that is configured to be above the support piece as a seating area of the swing apparatus.

The peripherally enclosing fabric 112 is configured to support and enclose the majority of the inner compartment or inner tube. The peripherally enclosing fabric 112 is a sturdy fabric with less stretchability than the top seating fabric 114. The peripherally enclosing fabric 112 supports and strengthens the inner compartment and may be configured to withstand wear and tear during use of the swing apparatus 100. In some embodiments, the peripherally enclosing fabric 112 is a durable nylon material. In the illustrated embodiment, the peripherally enclosing fabric 112 covers the outer diameter of the inner tube and further covers a majority of the bottom of the inner tube 310.

In the illustrated embodiment, the bottom mesh component 116 is found centered on the bottom of the covering 110. The bottom mesh component 116 is a meshed fabric that allows for the drainage of water from the swing apparatus 100. In the illustrated embodiment, the bottom mesh component 116 is circular and sized to match the size of the support piece 320 or be smaller than the support piece 320. In some embodiments, it may be larger in size or diameter. The primary function of the bottom mesh component 116 is to allow for egress of liquids and does not provide as much structural support as the peripherally enclosing fabric 112. In the illustrated embodiment, the peripherally enclosing fabric 112 and the bottom mesh component 116 are joined by sewing the pieces together. Other common methods of coupling are envisioned and embodiments herein are not restricted to being coupled through sewing. In addition, in the illustrated embodiment, the peripherally enclosing fabric 112 and the bottom mesh component 116 are further secured together by the straps (not visible but described in more detail below).

In addition, the covering includes a top seating fabric 114 that is coupled to the peripherally enclosing fabric 112 and is centered above the support piece of the inner tube. The top seating fabric 114 is generally circular (but could be other shapes) and covers the top of the inner tube and is generally larger in size or diameter than the support piece. In the illustrated embodiment, the top seating fabric 114 is flexible and stretchable. The top seating fabric 114 is much more stretchable than the peripherally enclosing fabric 112. This is for comfort of the seating area of the swing apparatus 100. The stretchable top seating fabric 114 allows a user to sink into the space created by the inner tube and sit comfortably on the swing apparatus 100. In some embodiments, the top seating fabric 114, while permeable, may have less permeability than the bottom mesh component 116. As such, in some embodiments, the top seating fabric 114 has two openings (see FIG. 5) at the periphery of the top seating fabric 114. These openings are between the top seating fabric 114 and the peripherally enclosing fabric 112. In some embodiments, the openings may be further covered by a mesh similar to the bottom mesh component 116 and they will allow for more egress of liquids. Although the covering 110 is described with certain components and functionality, other embodiments of the covering may include fewer or more components to implement less or more functionality.

In the illustrated embodiment, the top seating fabric 114 has two openings 118 (see FIG. 5) at the periphery of the top seating fabric 114. These openings 118 are between the top seating fabric 114 and the peripherally enclosing fabric 112. In some embodiments, the openings may be further covered by a mesh similar to the bottom mesh component 116 and they will allow for more egress of liquids.

In the illustrated embodiment, the covering includes a flap 132. The flap 132 can be opened to expose an inflation valve 340 on the inner compartment 300. This allows a user to easily inflate and deflate the inner tube through an access opening (covered by the flap 132) on the covering 110 without removing the inner compartment from the covering 110. The inflation valve will be aligned with the access opening. In the illustrated embodiment, flap 132 and access opening are located on the peripherally enclosing fabric 112 but may be located elsewhere in other embodiments.

The swing apparatus 100 includes at least two straps 210, 220. The straps 210, 220 are secured to the covering 110 and extend all the way across the bottom of the covering 110 (shown in FIG. 6). In the illustrated embodiment, the swing apparatus 100 includes two straps, a first strap 210 and a second strap 220. The straps 210, 220 are secured directly to the covering 110 and form a criss-cross pattern on the bottom of the swing apparatus 100 (this is visible in FIG. 6). In the illustrated embodiment, the straps 210, 220 are secured orthogonally to each other on the bottom.

The straps 210, 220 are secured to the covering 110 by sewing each lengthwise side of the strap the full length of the strap until the three-box reinforcement support 150. This provides further stability and strength to the covering 110 and thus to the overall swing apparatus 100. In the illustrated embodiment, the straps 210, 220 are sewn to the peripherally enclosing fabric 112 and to the bottom mesh component 116. This further secures the peripherally enclosing fabric 112 and to the bottom mesh component 116 together and provides more support to the swing apparatus (see FIG. 6 for this depiction).

Figure 7:
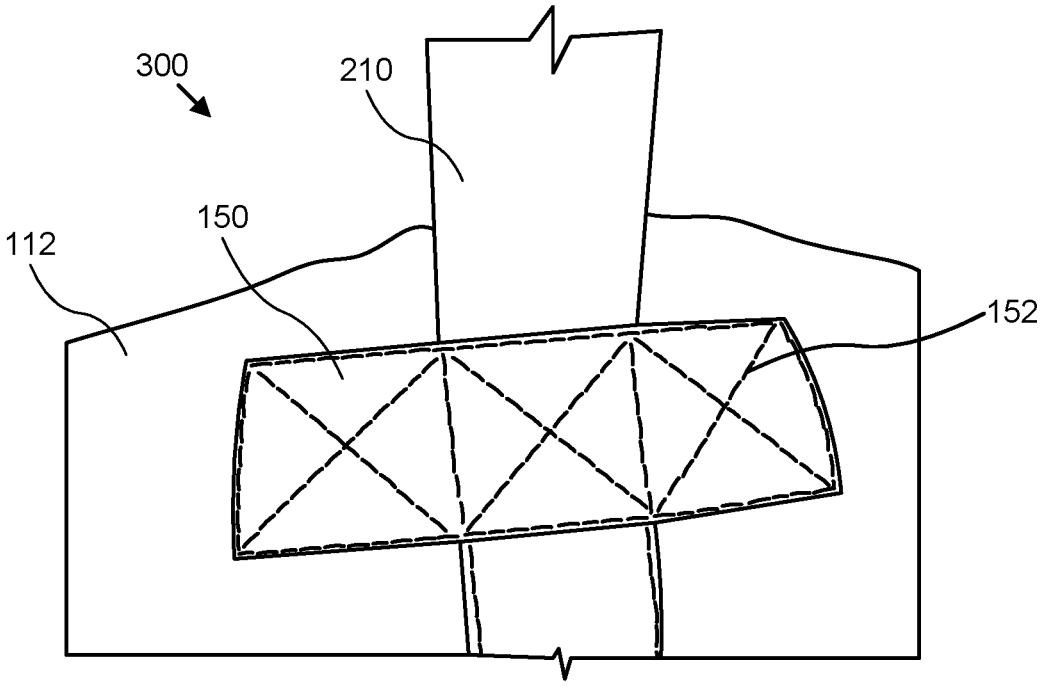
FIG. 7 depicts a close up view of a three-box reinforcement support that secures a strap to the covering, according to one or more embodiments of the invention.

FIG. 7 depicts a close up view 300 of a three-box reinforcement support 150 that secures a strap to the covering 110, according to one or more embodiments of the invention. As illustrated the three-box reinforcement support 150 is secured by a thread 152 to the covering 110 and more specifically to the peripherally enclosing fabric 112. The three-box reinforcement support 150 is just illustrative of a coupling of the strap 210 to the peripherally enclosing fabric 112 and should not be viewed as limiting to all embodiments.

Figure 8:
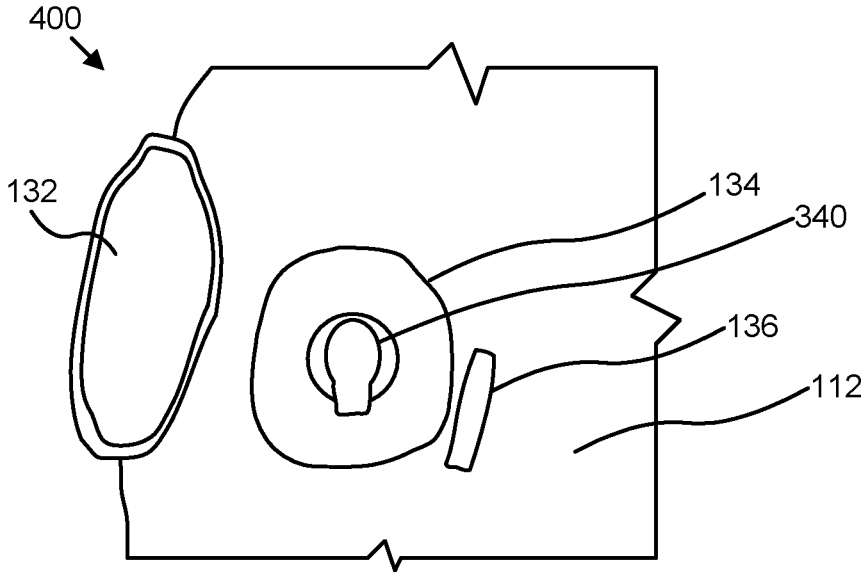
FIG. 8 depicts a close-up view of the flap and access opening, according to one or more embodiments of the invention.

FIG. 8 depicts a close-up view 400 of the flap and access opening, according to one or more embodiments of the invention. In the illustrated embodiment, the covering includes a flap 132. The flap 132 can be opened to expose an inflation valve 340 on the inner compartment 300. This allows a user to easily inflate and deflate the inner tube through an access opening 134 (usually covered by the flap 132) on the covering 110 without removing the inner compartment from the covering 110. The inflation valve 340 will be aligned with the access opening 134. In the illustrated embodiment, flap 132 and access opening 134 are located on the peripherally enclosing fabric 112 but may be located elsewhere in other embodiments.

Figure 9:
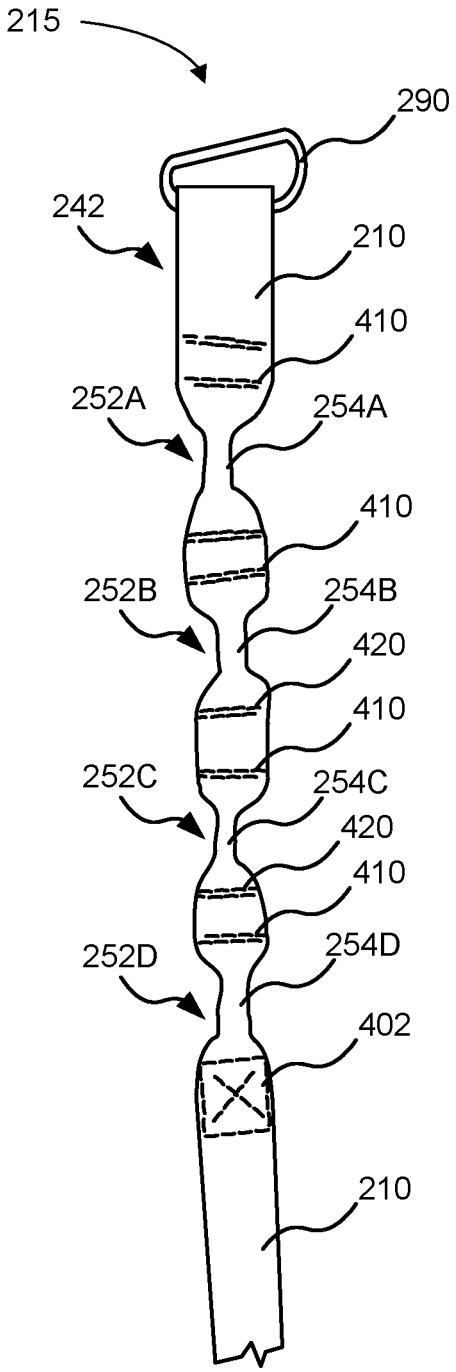
FIG. 9 depicts a front view of the two straps coupled together to form an attachment coupling, according to one or more embodiments of the invention.

FIG. 9 depicts a front view of the two straps coupled together to form an attachment coupling 215, according to one or more embodiments of the invention. The two straps (only one strap is visible) are secured together at their ends to create the attachment coupling 215. In the illustrative embodiment, the swing apparatus has two larger attachment couplings on each side of the swing apparatus. The attachment coupling 215 includes a series of circular attachment loops. In the illustrated embodiment, a carabiner 290 is attached to the end attachment handle loop 242, but the carabiner 290 (or other hardware) can be attached to any of the attachment handles 242, 252. This allows for the height of the swing apparatus 100 to be easily adjusted to conform to user desire. In the illustrative embodiment, the attachment coupling 215 includes four intermediary attachment loops 252 and an end attachment handle loop 242.

The attachment loops are formed by securing the two straps together at a first point (represented by thread 410) and a second point (represented by thread 420) spaced along the length of the straps 210, 220. Each strap is then pinched or folded in the space between the first point 410 and the second point 420 and the two pinched ends are sewn together (seen in FIG. 11). This forms a bulges 254, 264 that naturally separates to the two straps 210 220 between the first point 410 and the second point 420 and allows for the carabiner 290 (or other hardware) to easily be changed from the end attachment handle loop 242 to an intermediary attachment loop 252. The illustrated embodiments depicts four bulges 254A, 254B, 254C, 254D on the first strap 210 and four bulges 264A, 264B, 264C, 264D on the second strap 220

Figure 10:
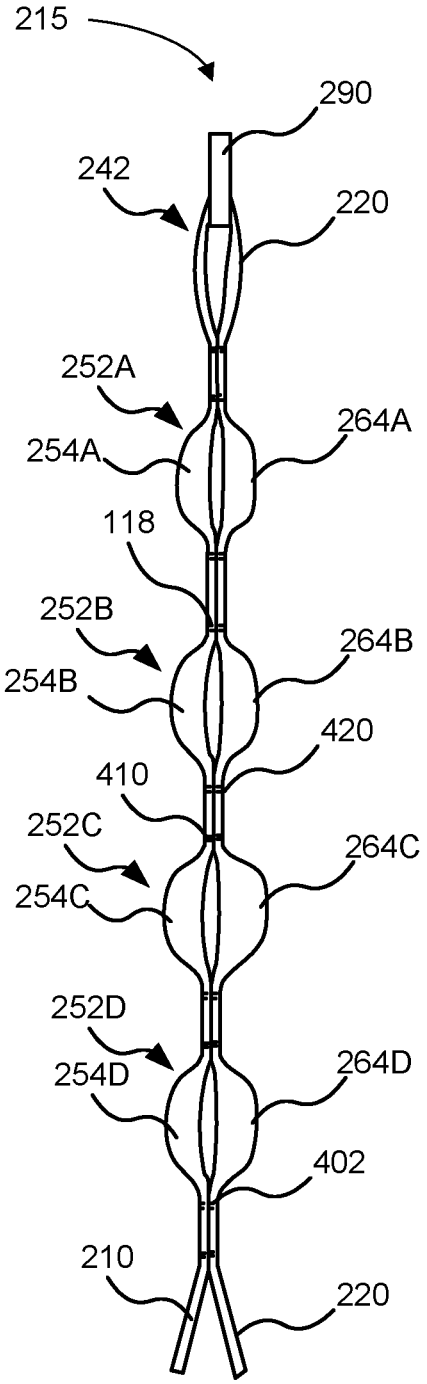
FIG. 10 depicts a side view of the two straps coupled together to form the attachment coupling of FIG. 9.
Figure 11:
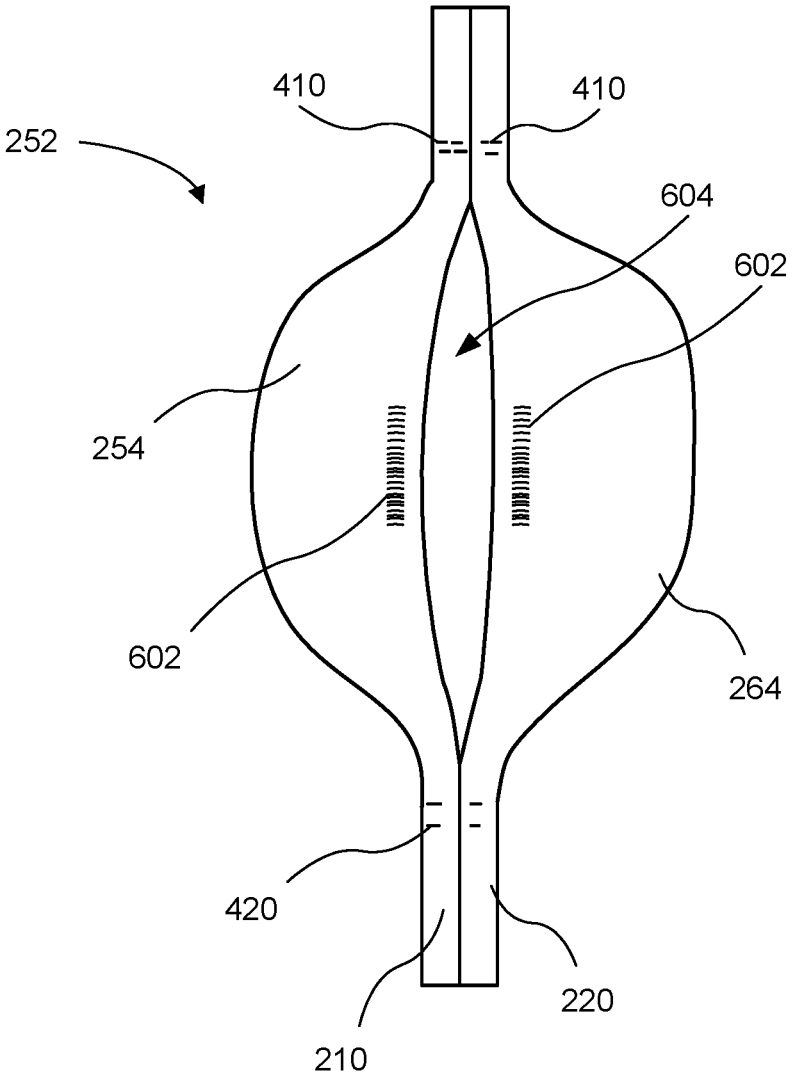
FIG. 11 depicts a close up view of one of the intermediary attachment loops, according to one or more embodiments of the invention.

FIG. 10 depicts a side view of the two straps coupled together to form the attachment coupling 215 of FIG. 9. The view of FIG. 10 is orthogonal to the view of FIG. 9. FIG. 11 depicts a close up view of one of the intermediary attachment loops 252, according to one or more embodiments of the invention. As shown in the close up, each strap is folded together and sewn by thread 602 securing the outer edges of the strap together. This forms the bulge 254, 264 and creates a loop opening 604 between the two strap 210, 220 and between the first point 410 and the second point 420.

In the above description, specific details of various embodiments are provided. However, some embodiments may be practiced with less than all of these specific details. In other instances, certain methods, procedures, components, structures, and/or functions are described in no more detail than to enable the various embodiments of the invention, for the sake of brevity and clarity.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

In the above description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Although specific embodiments of the invention have been described and illustrated, the invention is not to be limited to the specific forms or arrangements of parts so described and illustrated. The scope of the invention is to be defined by the claims appended hereto and their equivalents.

What is claimed is:

1. A swing apparatus comprising:

an inner compartment comprising an inner tube;

a covering that is configured to cover the inner compartment;

at least two straps comprising a first strap and a second strap that are each secured to a bottom of the covering and which are configured to extend above the covering and inner compartment with at least two attachment couplings;

wherein a first end of the first strap is coupled to a first end of the second strap to form the first attachment coupling; and wherein a second end of the first strap is coupled to a second end of the second strap to form a second attachment coupling, wherein the first end of the first strap and the second end of the first strap extend from the covering on opposite sides of the covering, and wherein the first end of the second strap and the second end of the second strap extend from the covering on opposite sides of the covering.

2. The swing apparatus of claim 1, wherein the inner tube is inflatable through an inflation valve.

3. The swing apparatus of claim 1, wherein the inner compartment further comprises a support piece coupled to the inner tube, wherein the support piece comprises a plurality of apertures configured to allow the egress of a liquid.

4. The swing apparatus of claim 3, wherein the covering comprises a peripherally enclosing fabric that is configured to cover the periphery of the inner compartment and bottom of the inner compartment.

5. The swing apparatus of claim 4, wherein the covering further comprises a bottom mesh component that is coupled to the peripherally enclosing fabric and is centered on a bottom of the swing apparatus below the support piece of the inner compartment.

6. The swing apparatus of claim 5, wherein the covering further comprises a top seating fabric that is coupled to the peripherally enclosing fabric and be centered on a top of the covering above the support piece of the inner compartment.

7. The swing apparatus of claim 6, wherein the top seating fabric is stretchable.

8. The swing apparatus of claim 1, wherein the first strap and the second strap cross each other orthogonally at a bottom of the covering such that the first strap overlaps the second strap.

9. The swing apparatus of claim 1, wherein the first strap and the second strap cross each other obliquely at a bottom of the covering such that the first strap overlaps the second strap.

10. The swing apparatus of claim 1, wherein the first attachment coupling comprises an end attachment handle loop and at least one intermediary attachment loop.

11. The swing apparatus of claim 1, wherein the first attachment coupling comprises an end attachment handle loop and a plurality of intermediary attachment loops configured to allow the swing height to be adjusted.

12. The swing apparatus of claim 11, wherein the intermediary attachment loops are formed with an opening between the first strap and the second strap which are sewn together at a first point and a second point.

13. A swing apparatus comprising:

an inner compartment comprising an inner tube, wherein the inner tube is inflatable through an inflation valve, and wherein the inner compartment further comprises a support piece coupled to the inner tube, wherein the support piece comprises a plurality of apertures configured to allow the egress of a liquid;

a covering that is configured to cover the inner compartment, wherein the covering comprises a peripherally enclosing fabric that is configured to cover the periphery of the inner compartment and bottom of the inner compartment, wherein the covering further comprises a bottom mesh component that is coupled to the peripherally enclosing fabric and is centered on a bottom of the swing apparatus below the support piece of the inner compartment, and wherein the covering further comprises a top seating fabric that is coupled to the peripherally enclosing fabric and be centered on a top of the covering above the support piece of the inner compartment;

at least two straps comprising a first strap and a second strap that are each secured to a bottom of the covering and which are configured to extend above the covering and inner compartment with at least two attachment couplings;

wherein a first end of the first strap is coupled to a first end of the second strap to form the first attachment coupling; and wherein a second end of the first strap is coupled to a second end of the second strap to form a second attachment coupling, wherein the first end of the first strap and the second end of the first strap extend from the covering on opposite sides of the covering, and wherein the first end of the second strap and the second end of the second strap extend from the covering on opposite sides of the covering.

14. The swing apparatus of claim 13, wherein the top seating fabric is stretchable.

15. The swing apparatus of claim 13, wherein the first strap and the second strap cross each other orthogonally at a bottom of the covering such that the first strap overlaps the second strap.

16. The swing apparatus of claim 13, wherein the first strap and the second strap cross each other obliquely at a bottom of the covering such that the first strap overlaps the second strap.

17. The swing apparatus of claim 13, wherein the first attachment coupling comprises an end attachment handle loop and at least one intermediary attachment loop.

18. The swing apparatus of claim 13, wherein the first attachment coupling comprises an end attachment handle loop and a plurality of intermediary attachment loops configured to allow the swing height to be adjusted.

19. The swing apparatus of claim 18, wherein the intermediary attachment loops are formed with an opening between the first strap and the second strap which are sewn together at a first point and a second point.

* * * * *